US009067760B2

(12) United States Patent
Bunter et al.

(10) Patent No.: US 9,067,760 B2
(45) Date of Patent: Jun. 30, 2015

(54) COMMUNICATION WITH AN ELEVATOR SYSTEM

(75) Inventors: Adrian Bunter, Beckenried (CH); Stefano Carriero, Oberkirch (CH)

(73) Assignee: Inventio AG, Hergiswil NW (CH)

( * ) Notice: Subject to any disclaimer, the term of this patent is extended or adjusted under 35 U.S.C. 154(b) by 814 days.

(21) Appl. No.: 13/265,665

(22) PCT Filed: Apr. 21, 2010

(86) PCT No.: PCT/EP2010/055236

§ 371 (c)(1),
(2), (4) Date: Oct. 21, 2011

(87) PCT Pub. No.: WO2010/122041

PCT Pub. Date: Oct. 28, 2010

(65) Prior Publication Data

US 2012/0051449 A1 Mar. 1, 2012

(30) Foreign Application Priority Data

Apr. 24, 2009 (EP) ..... 09158679

(51) Int. Cl.
*B66B 1/28* (2006.01)
*B66B 5/00* (2006.01)

(52) U.S. Cl.
CPC ..... *B66B 5/0018* (2013.01); *B66B 5/0087* (2013.01)

(58) Field of Classification Search
CPC ..... B66B 5/0018; B66B 5/0087
USPC ..... 187/247, 248, 391–394
See application file for complete search history.

(56) References Cited

U.S. PATENT DOCUMENTS

| | | | | |
|---|---|---|---|---|
| 3,973,648 | A * | 8/1976 | Hummert et al. | 187/393 |
| 4,568,909 | A * | 2/1986 | Whynacht | 187/393 |
| 4,823,914 | A | 4/1989 | McKinney | |
| 5,064,026 | A | 11/1991 | Nagata et al. | |
| 5,202,540 | A * | 4/1993 | Auer et al. | 187/247 |
| 5,360,952 | A * | 11/1994 | Brajczewski et al. | 187/248 |
| 5,398,782 | A * | 3/1995 | Talbot et al. | 187/393 |
| 7,073,633 | B2 | 7/2006 | Weinberger et al. | |
| 7,318,500 | B2 * | 1/2008 | Rekinen et al. | 187/391 |
| 7,398,860 | B2 * | 7/2008 | Amano | 187/247 |
| 7,467,400 | B1 * | 12/2008 | Moss et al. | 726/3 |
| 7,558,564 | B2 * | 7/2009 | Wesby | 455/419 |
| 8,230,977 | B2 * | 7/2012 | Thumm et al. | 187/247 |
| 8,341,270 | B2 * | 12/2012 | Mazzaferri et al. | 709/227 |
| 2004/0034794 | A1 * | 2/2004 | Mayer et al. | 713/200 |
| 2005/0120242 | A1 * | 6/2005 | Mayer et al. | 713/201 |
| 2009/0119762 | A1 * | 5/2009 | Thomson et al. | 726/7 |

FOREIGN PATENT DOCUMENTS

| | | |
|---|---|---|
| CN | 101374357 B | 12/2010 |
| EP | 1415947 | 10/2003 |
| GB | 2276954 | 10/1994 |

* cited by examiner

*Primary Examiner* — Anthony Salata
(74) *Attorney, Agent, or Firm* — Stroock & Stroock & Lavan LLP

(57) ABSTRACT

A method for communication between an elevator system and a remote control center includes establishing a communication connection in a communication network. A first signal of the elevator system is received by a communication device of the elevator system through a signal network, and a second signal is transmitted by the communication device in the communication network to a computing apparatus of the remote control center. The communication connection is permanently maintained.

7 Claims, 3 Drawing Sheets

| | | | |
|---|---|---|---|
| 1 | ELEVATOR CABIN | S1, S2, S3 | FLOORS |
| 1' | ESCALATOR | S4 | SHAFT |
| 2 | FLOOR DOOR | Z | CONTROL CENTER |
| 3 | ELEVATOR DOOR | | |
| 4 | CALL INPUT APPARATUS | | |
| 5 | CABIN TELEPHONE | | |
| 5.1 | VOICE SIGNAL | | |
| 5.2 | SENSOR DATA SIGNAL | | |
| 5', 5'', 5''' | SENSOR | | |
| 6 | COUNTERWEIGHT | | |
| 7 | DRIVE | | |
| 8 | SUPPORT | | |
| 10 | CONTROLLER | | |
| 11 | CALL CONTROLLER | | |
| 13 | COMMUNICATION APPARATUS | | |
| 15 | COMPUTER | | |

| | |
|---|---|
| 13.0 | FIREWALL |
| 13.1 | PROCESSOR |
| 13.2 | MEMORY |
| 13.3 | TELEPHONE |
| 13.4 | CONVERTER |
| 13.5 | POWER SUPPLY |
| 13.6 | TELEPHONE PORT |
| 13.7 | BUS PORT |
| 13.8 | NETWORK PORT |
| 13.9 | PORT |
| 13.10 | RADIO ANTENNA |
| 13.11 | TELEPHONE PORT |
| 13.12 | NETWORK PORT |

| | |
|---|---|
| 15.1 | PROCESSOR |
| 15.2 | MEMORY |
| 15.3 | TELEPHONE |
| 15.4 | CONVERTER |
| 15.5 | POWER SUPPLY |
| 15.8 | NETWORK PORT |
| 15.9 | PORT |
| 15.10 | ANTENNA |
| 15.11 | TELEPHONE PORT |
| 15.12 | NETWORK PORT |

COMMUNICATION WITH AN ELEVATOR SYSTEM

FIELD

The disclosure relates to communication with an elevator system.

BACKGROUND

The specification EP1415947A1 describes an apparatus and a method for the remote servicing of an elevator system, which apparatus is installed on the elevator system and receives first signals from an elevator controller and/or from a sensor. The apparatus evaluates received first signals on the basis of an activated remote servicing function and forwards the result of said evaluation as second signals via a telecommunication network to a remote servicing center.

SUMMARY

At least some embodiments comprise a method for communication between at least one elevator system and at least one remote supervisory control center; wherein said communication involves at least one communicative connection being set up in at least one communication network; wherein at least one first signal from the elevator system is picked up by at least one communication apparatus in the elevator system via at least one signal network, and at least one second signal is transmitted from the communication apparatus in a communication network to at least one computer device in the remote supervisory control center. In at least some cases, the communicative connection is maintained permanently.

This can mean that the communication does not require any connection setup, which can increase the quality and availability of the communication. Whereas a Plain Old Telephone Service (POTS) involves a subscriber dialing up and requiring, for example, around 30 seconds for the setup of an exclusive temporary connection, the communicative connection according to some embodiments can be maintained permanently and can be available in fractions of a second. For example, in emergencies, where the elevator system requests assistance from the remote supervisory control center and emergency measures are initiated on the elevator system from the remote supervisory control center, the time saving provided by means of the highly available communicative connection can be important in relation to safety.

In some cases, the communicative connection is set up by the communication apparatus.

This can mean that the communication apparatus sets up the communicative connection and therefore does not require a fixed address in the communication network, which can be likewise relevant to safety, since the communication apparatus is therefore known to third parties in the communication network. The address of the communication apparatus in the communication network can be known only to the remote supervisory control center, which can form an effective preventive measure against attacks by viruses or Trojans.

In some cases, at least one signaling channel in the setup communicative connection transmits continuously using at least one physical channel.

This can mean that the communicative connection is maintained by using a signaling channel for continuous sending. In the telephone radio network based on the Global System for Mobile Communications (GSM), the communication is effected using Time Division Multiplex Access (TDMA) timeslots lasting 577 μsec, for example. In some cases, the signaling channel always sends at maximum power so that the communication apparatus can select the strongest receivable signaling channel, depending on the currently available bandwidth in the communication network, for a safe communicative connection.

In further embodiments, the communicative connection is set up by the communication apparatus; during the communicative connection, the communication apparatus transmits a second signal, and at least one firewall in the communication apparatus prevents signal reception.

This can mean that the communication apparatus sets up the communicative connection and a firewall in the communication apparatus only allows the transmission of a second signal by the communication apparatus, but no signal reception by the communication apparatus, which again can form a safety-relevant measure against attacks by viruses or Trojans.

In some embodiments, the communicative connection used is a Virtual Private Network (VPN) as a communication network.

This can mean that the communication apparatus and the remote supervisory control center are effected in a private, i.e. individually configurable, communication network. For example, only the communication apparatus knows the private address of the remote supervisory control center in the communication network, and only the remote supervisory control center knows the private address of the communication apparatus in the communication network.

In some embodiments, the communicative connection used is a Virtual Private Network (VPN) with tunnel technology as a communication network. Possibly, the communication apparatus transmits a second signal in encrypted form.

This can mean that the communication network is based on tunnel technology, in which the second signal to be communicated is embedded into a communication protocol which is enclosed by a shell which disguises the actual content for third parties. The second signal to be communicated can be therefore encrypted so as to be bugproof, for example as a Secure Sockets Layer (SSL), prior to the communication and is correspondingly decrypted when communication has taken place.

In some embodiments, the communicative connection used is a Wireless Wide Area Network (WWAN) without internet access.

This can mean that a public and hence basically unprotected communication network such as the internet is not used. The communicative connection is therefore effected to the exclusion of the public, which can further increase the safety of the communication.

In some cases, the communicative connection used is a LAN with internet access.

This can mean that an inexpensive communicative connection is effected in a public communication network. In order to help assure safety against third parties, an encrypted communicative connection is effected. In addition, firewalls are installed on the communication apparatus and the remote supervisory control center, which firewalls use at least one predefined rule to stipulate whether or not signal reception is prevented.

In some cases, the communication network used is a telephone radio network. Possibly, the communication network used is a radio network.

This can mean that the communication network used is a known and proven telephone radio network such as GSM, General Radio Packet Services (GPRS), Enhanced Data Rate for GSM Evolution (EDGE), Universal Mobile Telecommunications System (UMTS), High Speed Download Packet Access (HSDPA), etc., which can ensure a high level of availability and hence safety for the communicative connection.

Possibly, the communication network used is a telephone landline network. Possibly, the communication network used is a network.

This can mean that the communication network used is a known and proven telephone landline network such as Integrated Services Digital Network (ISDN), Asymmetric Digital Subscriber Line (ADSL), Very High Data Rate Digital Subscriber Line (VDSL), etc., which can ensure a high level of availability and hence safety for the communicative connection.

Possibly, at least one voice signal is transmitted as a first signal from at least one elevator cabin telephone in the signal network to the communication apparatus; and at least one data signal is transmitted as a first signal from the elevator cabin telephone in the signal network to the communication apparatus.

This can mean that both a voice signal and a data signal from an elevator cabin telephone are transmitted in the signal network to the communication apparatus.

Possibly, the transmitted data signal is converted by the communication apparatus into at least one second signal; and the second signal is transmitted from the communication apparatus via the communicative connection at a transfer rate of at least 4.8 kbit/sec.

This can mean that the data signal is converted into a second signal for the purpose of communication, which second signal can be communicated safely and reliably at a transfer rate of at least 4.8 kbit/sec. For example, in the case of a GSM communication network, the transfer rate can drop drastically when the communication network is saturated, which impairs the transfer quality of the second signal. If, in an emergency, a second signal from the communication apparatus cannot be read reliably by the remote supervisory control center on account of the poor transfer quality, this can be of significance in relation to safety. In this case, a transfer rate of at least 4.8 kbit/sec can ensure that the communicative connection is sufficiently robust for a transmitted second signal to be read reliably.

Possibly, the transmitted data signal is converted by the communication apparatus into at least one Cellular Text Modem (CTM) signal as a second signal.

This can mean that the data signal is converted into a CTM signal as a second signal for the purpose of communication, which CTM signal can be communicated safely and reliably.

Possibly, at least one Dual-Tone Multi Frequency (DTMF) signal is transmitted as a first signal from at least one elevator cabin telephone in the signal network to the communication apparatus; and the transmitted DTMF signal is converted via the communication apparatus into at least one CTM signal as a second signal.

This can mean that a DTMF signal, which is known from analogue telephone technology, is converted into second signals for the purpose of communication, which second signals can be communicated safely and reliably. The DTMF signal is a multifrequency signal having dissonances, which can become distorted when the bandwidth of the communication network is saturated and hence are no longer explicitly identifiable with a high level of certainty.

Possibly, the CTM signal is transferred from the communication apparatus via the communicative connection to the remote supervisory control center. Possibly, the transferred CTM signal is converted by the remote supervisory control center into at least one data signal. Possibly, the transferred CTM signal is converted by the remote supervisory control center into at least one DTMF signal.

This can mean that the remote supervisory control center converts a transferred CTM signal into a DTMF signal. Particularly in an emergency, where a data signal communicated by the communication apparatus needs to be read reliably by the remote supervisory control center, this can be important in relation to safety.

Possibly, at least one sensor transmits at least one sensor signal as a first signal in the signal network to the communication apparatus. Possibly, the sensor signal is used to indicate at least one status information item for the elevator system, such as a statement relating to at least one operational readiness and/or relating to at least one error log and/or relating to at least one utilization level per unit time. Possibly, at least one elevator controller in the elevator system transmits at least one data signal as a first signal in the signal network to the communication apparatus. Possibly, at least one escalator controller in the elevator system transmits at least one data signal as a first signal in the signal network to the communication apparatus. Possibly, at least one call controller in the elevator system transmits at least one data signal as a first signal in the signal network to the communication apparatus. Possibly, the data signal is used to indicate at least one status information item for the elevator controller and/or escalator controller and/or call controller, such as a statement relating to at least one operational readiness and/or relating to at least one error log and/or relating to at least one utilization level per unit time.

This can mean that not only an elevator cabin telephone but also a sensor, an elevator controller and a call controller transmit a first signal to the communication apparatus.

Possibly, a first signal is converted by the communication apparatus into a second signal; the second signal is transmitted from the communication apparatus in the communication network to the computer device in the remote supervisory control center; a transmitted second signal is converted by the computer device into a first signal; and the computer device evaluates the converted first signal.

This can mean that the communication apparatus converts the first signal into a second signal and transmits the second signal safely and reliably to the remote supervisory control center. The computer device in the remote supervisory control center can convert the safely and reliably transmitted second signal into a first signal and can evaluate it. The safe and reliable transmission can mean that the evaluation of the first signals is not impaired by transmission interference.

Possibly, the first signal evaluated by the computer device is used to indicate at least one status information item for the elevator system and/or communication apparatus and/or elevator controller and/or escalator controller and/or call controller, such as a statement relating to at least one operational readiness and/or relating to at least one error log and/or relating to at least one utilization level per unit time.

This can mean that the remote supervisory control center arrives at meaningful status information.

Possibly, at least one Short Message Service (SMS) signal is transferred from the remote supervisory control center via the communicative connection to the communication apparatus. Possibly, at least one SMS signal is transferred from the remote supervisory control center via a signaling channel in the communicative connection to the communication apparatus.

This can mean that the remote supervisory control center is fed back in the form of an SMS signal, which can meet the high safety demands in the field of elevators.

Possibly, the communication apparatus is reconfigured and/or booted by the transferred SMS signal. Possibly, the transferred SMS signal is transmitted from the communication apparatus via a signal network to at least one elevator controller; and the elevator controller is reconfigured and/or booted by the transferred SMS signal. Possibly, the transferred SMS signal is transmitted from the communication apparatus via a signal network to at least one escalator controller; and the escalator controller is reconfigured and/or booted by the transferred SMS signal. Possibly, the transferred SMS signal is transmitted from the communication apparatus via a signal network to at least one call controller; and the call controller is reconfigured and/or booted by the transferred SMS signal. Possibly, the transferred SMS signal is transmitted from the communication apparatus via a signal network to at least one elevator cabin telephone; and the elevator cabin telephone is reconfigured and/or booted by the transferred SMS signal. Possibly, the transferred SMS signal is transmitted from the communication apparatus via a signal network to at least one sensor; and the sensor is reconfigured and/or booted by the transferred SMS signal.

This can mean that parts of the elevator system such as the communication apparatus, the elevator controller, the call controller, the elevator cabin telephone and a sensor can be easily, quickly and individually reconfigured and/or booted by an SMS signal from the remote supervisory control center.

Possibly, a computer program product comprises at least one computer program means which is suitable for implementing the method for communication with the elevator system by virtue of at least one method step being executed when the computer program means is loaded into at least one processor in a communication apparatus and/or into at least one DTMF/CTM converter in a communication apparatus and/or into at least one processor in a computer device and/or into at least one DTMF/CTM converter in a computer device. Possibly, a computer-readable data memory comprises such a computer program product.

BRIEF DESCRIPTION OF THE DRAWINGS

Exemplary embodiments of the disclosed technologies are explained in detail with reference to the figures, in which, in partially schematic form.

DETAILED DESCRIPTION

Figure 1:
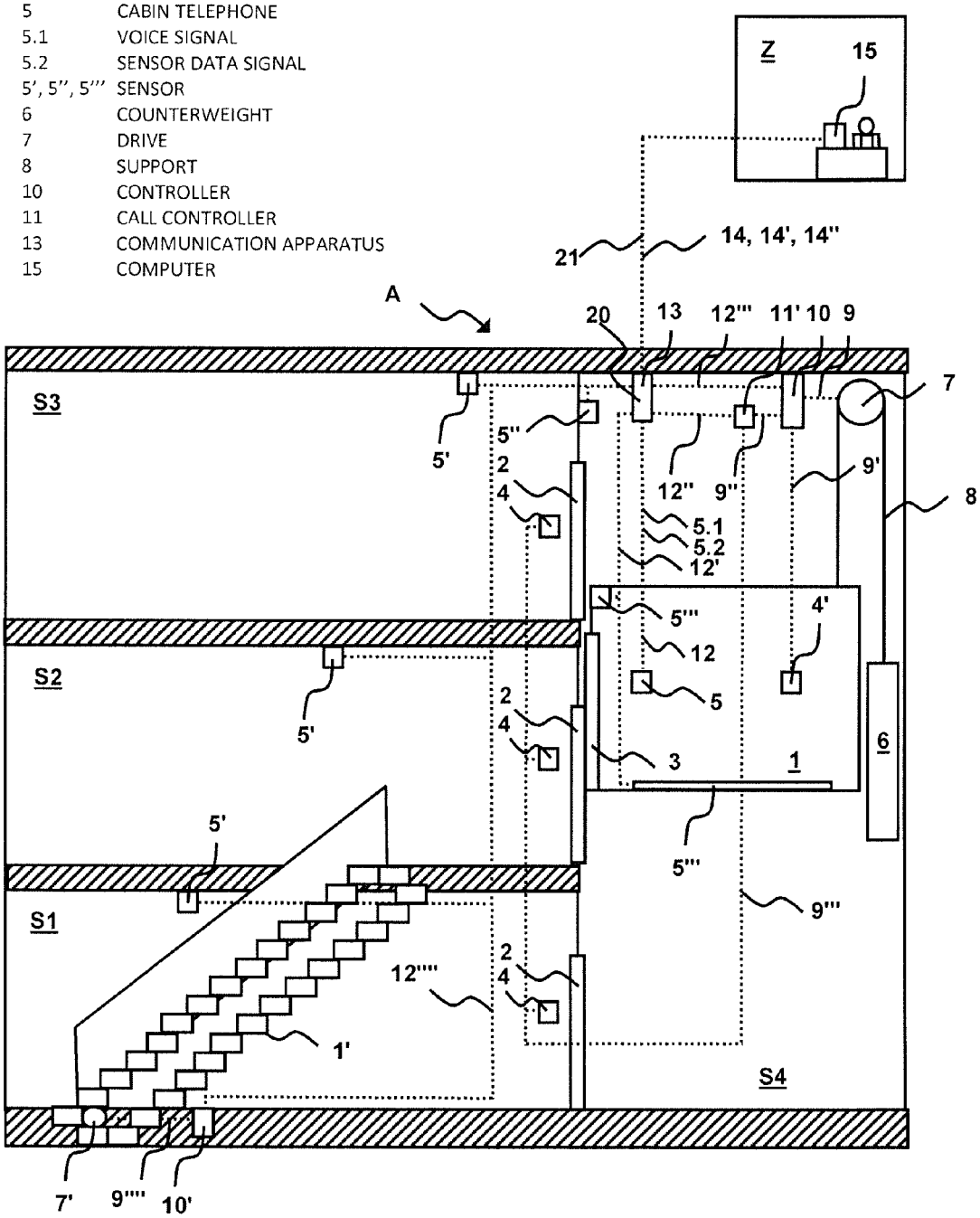
FIG. 1 shows a view of a portion of an elevator system which communicates with a remote supervisory control center.
Figure 2:
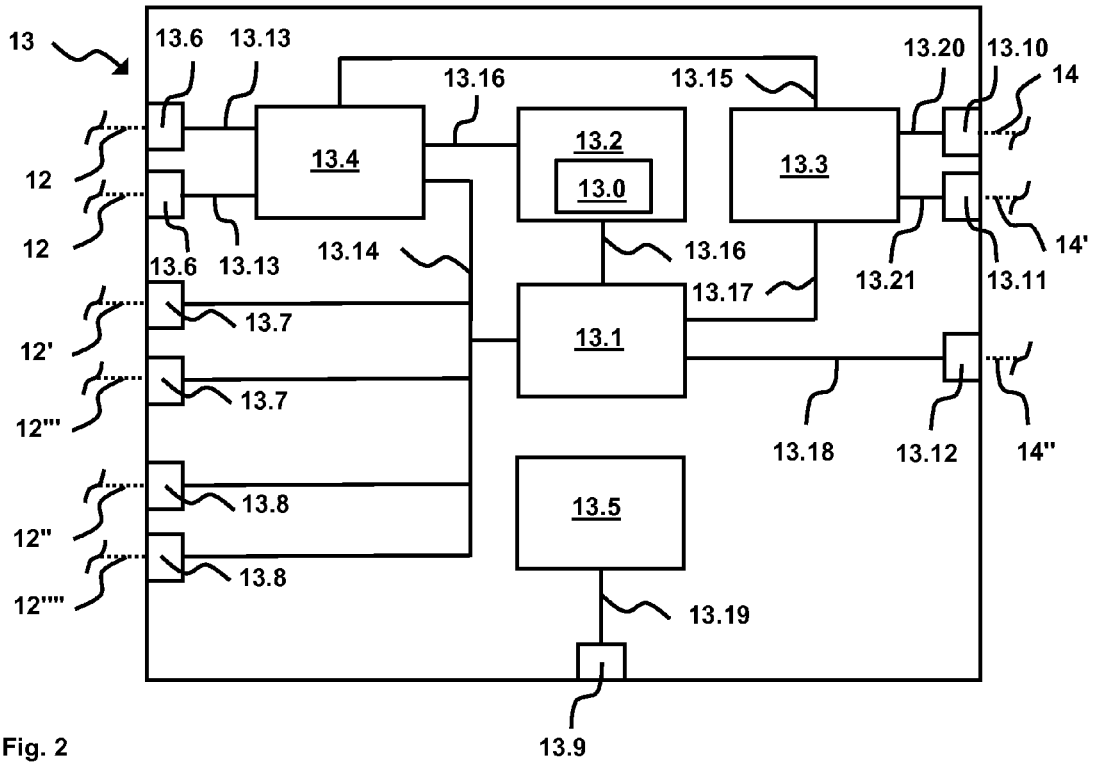
FIG. 2 shows a view of a portion of a communication apparatus in an elevator system as shown in FIG. 1.
Figure 3:
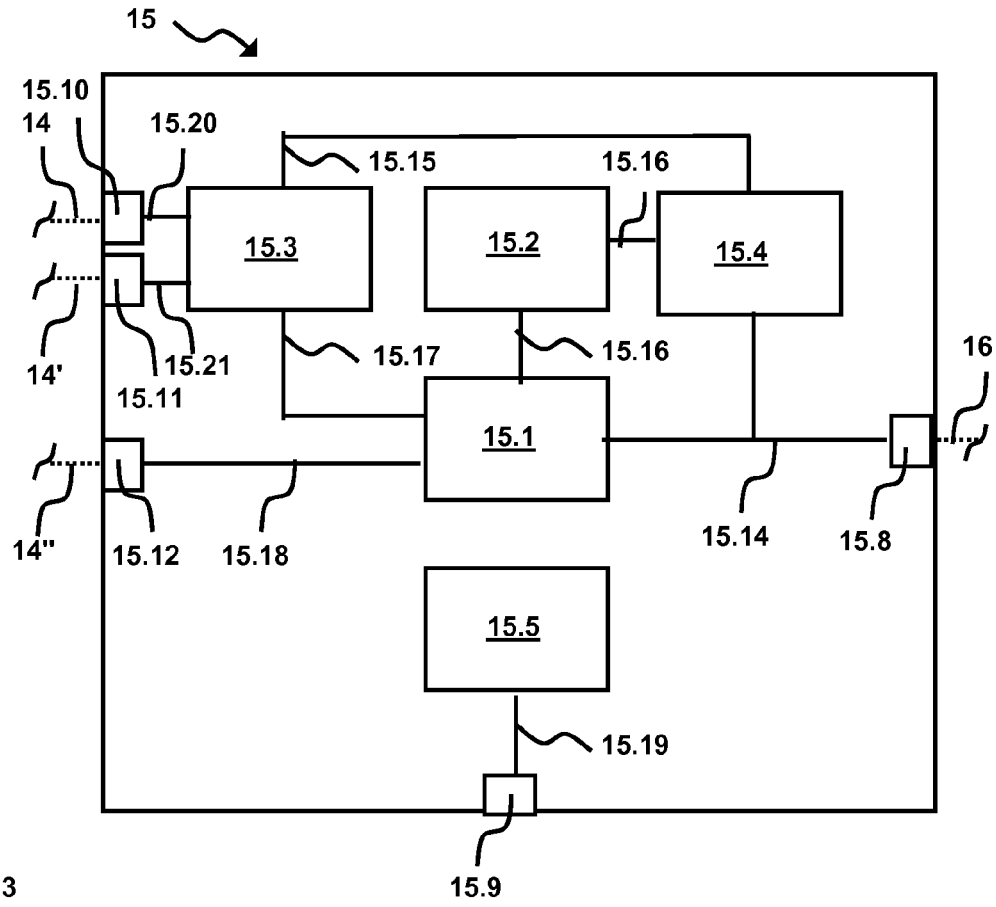
FIG. 3 shows a view of a portion of a computer device in a remote supervisory control center as shown in FIG. 1.

FIGS. 1 to 3 show exemplary embodiments of the disclosed technologies. At least one elevator system A is installed in a building having a plurality of floors S1 to S3. The elevator system A comprises at least one elevator cabin 1 and/or at least one escalator 1'. FIG. 1 shows an escalator 1' between a lower floor S1 and a middle floor S2, and an elevator cabin 1 in an elevator shaft S4. The elevator cabin 1 is connected to a counterweight 6 by means of at least one supporting means 8. To move the elevator cabin 1 and the counterweight 6, the supporting means 8 is set in motion by an elevator drive 7 in frictionally engaged fashion, so that passengers in the elevator cabin 1 are transported in the upward or downward direction in the building. The escalator 1' has a multiplicity of pallets which are driven clockwise or counterclockwise by an escalator drive 7'. Merely for reasons of clarity, FIG. 1 shows only one elevator cabin 1 and only one escalator 1'. In knowledge of this disclosure, a person skilled in the art can implement an elevator system having a plurality of elevator cabins and/or a plurality of escalators for a building having more or fewer than three floors. A person skilled in the art is also able to implement the disclosed technologies in an elevator system having double and triple cabins; having a plurality of elevator cabins, arranged above one another and movable independently of one another, per elevator shaft; having elevators without a counterweight; having hydraulic elevators; having moving walkways, etc. In accordance with FIG. 1, each floor S1 to S3 has a floor door 2, and the elevator cabin 1 has an elevator door 3. The floor doors 2 and the elevator door 3 are opened and closed by at least one door drive—not shown—so that passengers can enter and leave the elevator cabin 1. In knowledge of this disclosure, a person skilled in the art is naturally also able to implement an elevator system having an elevator cabin with a plurality of elevator doors and/or with a plurality of floor doors per floor.

At least one elevator controller 10 and at least one escalator controller 10' each have at least one processor and at least one computer readable data memory, at least one electrical power supply, at least one signal port for at least one signal line 9, 9', 9'''' and at least one signal port for at least one signal network 12''', 12''''. In accordance with FIG. 1, the elevator controller 10 is connected by means of a signal line 9 to the elevator drive 7 and to a shaft information item—not shown—and also by means of a signal line 9' to a call input apparatus 4' and to the door drive in the elevator cabin 1. The escalator controller 10' is connected by means of a signal line 9'''' to the escalator drive 7'. The communication via the signal line 9, 9', 9'''' is effected using analogue signals and is unidirectional or bidirectional. The signal line 9 is in the form of a buried cable. The signal line 9' is suspended in the elevator shaft S4, and the signal line 9'''' is laid in a pit on floor S1. From the computer-readable data memory, at least one computer program means is loaded into the processor and executed. In the case of the elevator controller 10, the computer program means controls the movement of the elevator cabin 1 and the opening and closing of the floor doors 2 and the elevator door 3. From the shaft information, the elevator controller 10 obtains information about the current position of the elevator cabin 1 in the elevator shaft S4. The computer program means in the elevator controller 10 also outputs at least one data signal on the signal port in the signal network 12''', which data signal indicates at least one status information item for the elevator controller 10. A typical status information item for the elevator controller 10 is a statement relating to at least one operational readiness (yes/no), relating to at least one error log (list of error codes and/or messages), relating to at least one utilization level per unit time, etc. In the case of the escalator controller 10', the computer program means controls the movement of the pallets in the escalator 1'. The computer program means in the escalator controller 10' also outputs at least one data signal on the signal port in the signal network 12'''', which data signal indicates at least one status information item for the escalator controller 10'. A typical status information item for the escalator controller 10' is a statement relating to at least one operational readiness (yes/no), relating to at least one error log (list of error codes and/or messages), relating to at least one utilization level per unit time, etc. In knowledge of the present disclosure, a person skilled in the art is also able to implement the communication between the elevator controller and the elevator drive and the shaft information item and also the call input apparatus and the door drive in the elevator cabin using a digital signal network, described below, and/or a communication network, described below, instead of using signal lines.

At least one call input apparatus 4, 4' is arranged on a floor S1 to S3 close to a floor door 2 and/or in the elevator cabin 1. At least one housing of the call input apparatus 4, 4' contains at least one signal port for the signal line 9', 9''', at least one input/output unit in the form of a keypad and/or a touchscreen, at least one tone generator and at least one electrical power supply. A passenger makes a call by manually pressing at least one key on a keypad on the input/output unit and/or touching at least one area of a touchscreen on the input/output unit. By way of example, the passenger inputs the destination floor "20" manually as a numerical sequence "2" and "0" on the input/output unit. The call input apparatus 4, 4' uses the input/output apparatus to output visual confirmation of the call made and/or uses the tone generator to output audible confirmation of the call made. The call input apparatus 4 on the floors can be used by the passenger to make a floor call and/or destination call; the call input apparatus 4' in the elevator cabin 1 can be used by the passenger to make a cabin call.

At least one call controller 11 has at least one processor, at least one computer readable data memory, at least one signal port for at least one signal line 9'', 9''', at least one signal port for at least one signal network 12'' and at least one electrical power supply. In accordance with FIG. 1, the call controller 11 is a separate electronic unit in at least one dedicated housing, said unit being arranged in the elevator shaft S4, for example. The call controller 11 may also be an electronic slide-in unit, for example in the form of a printed circuit board, which printed circuit board is arranged in the housing of a call input apparatus 4, 4' and/or an elevator controller 10. From the computer readable data memory, at least one computer program means is loaded into the processor and is executed. The computer program means controls allocation of at least one elevator cabin 1 to at least one call made. To this end, the call input apparatus 4 uses the signal line 9''' to transmit at least one call signal to the call controller 11 for a call which has been made. In the case of an elevator system A having a plurality of elevators, the computer program means allocates to the call that elevator cabin 1 which can handle the call for the shortest waiting time and/or destination time for the passenger, for example the elevator cabin 1 which is closest to the call input floor. For a call allocation, the call controller 11 transmits at least one confirmation signal via the signal line 9''' to the call input apparatus 4 on which the call was made, which call input apparatus 4 outputs a confirmation for the transmitted confirmation signal. For a call allocation, the call controller 11 uses the signal line 9'' to transmit at least one journey signal to the elevator controller 10, from which journey signal the computer program means in the elevator controller 10 controls the movement of the elevator cabin 1 and the opening and closing of the floor doors 2 and the elevator door 3. The call controller 11 also outputs at least one data signal on the signal port in the signal network 12'', which data signal indicates at least one status information item for the call controller 11. A typical status information item for the call controller 11 is a statement relating to at least one operational readiness (yes/no), relating to at least one error log (list of error codes and/or messages), relating to at least one utilization level per unit time, etc.

At least one elevator cabin telephone 5 is arranged in the elevator cabin 1. In accordance with FIG. 1, the elevator cabin telephone 5 is arranged permanently in the elevator cabin 1. The elevator cabin telephone 5 has at least one processor, at least one computer readable data memory, at least one operator control key and/or an operator control panel, at least one microphone, at least one loudspeaker, at least one landline network telephone port and at least one electrical power supply. From the computer readable data memory, at least one computer program means is loaded into the processor and is executed. The computer program means controls a telephone connection to the elevator cabin telephone 5. The landline network telephone port is a Foreign Exchange Office (FXO), for example in the form of a standardized telephone port such as WAGO 231-XYZ, Registered Jack 45 (RJ45), etc. In accordance with FIG. 1, the landline network telephone port connects the elevator cabin telephone 5 to at least one signal network 12. The computer program means in the telephone 5 sets up an analogue telephone connection to the signal network 12 and maintains it permanently. From the signal network 12, the elevator cabin telephone 5 receives at least one dialing signal, at least one call signal and the electrical power supply. The elevator cabin telephone 5 can be activated by a passenger using the operator control key and/or the operator control panel. The microphone of the activated telephone 5 captures speech from the elevator cabin 1, which captured speech is transmitted as voice signals 5.1 to the signal network 12. Voice signals 5.1 received from the signal network 12 by the activated elevator cabin telephone 5 are output by the loudspeaker. In knowledge of the present disclosure, a person skilled in the art can also provide an analogue telephone without a processor and without a computer readable data memory as the elevator cabin telephone 5, for example in the form of a handsfree system or intercom, where an analogue telephone connection to the signal network 12 is maintained permanently. Finally, the elevator cabin telephone 5 may also be a digital telephone such as Voice over Internet Protocol (VoIP), where the microphone converts captured speech into digital data signals 5.2 and supplies them to a network on the basis of the IP.

At least one sensor 5' to 5''' in the elevator system A captures at least one capture range for the elevator system A. In accordance with FIG. 1, a plurality of sensors 5' are arranged on floors S1 to S3 of the building; at least one sensor 5'' is arranged in the elevator shaft S4; and a plurality of sensors 5''' are arranged in and/or on the elevator cabin 1. The sensor 5' to 5''' is a light sensor and/or a camera and/or an ultrasonic sensor and/or an infrared sensor and/or a weighing apparatus and/or a noise level sensor and/or a position sensor and/or a speed sensor and/or an acceleration sensor. The sensor 5' to 5''' has at least one processor, at least one computer readable data memory, at least one signal port for at least one signal network 12 to 12'''' and at least one electrical power supply. From the computer readable data memory, at least one computer program means is loaded into the processor and is executed. The computer program means controls the sensor 5' to 5''', the signal port and the electrical power supply. Exemplary embodiments of the sensor 5' to 5''' are explained below:

- the light sensor operates on the basis of the photoelectric effect and is a photodiode or a phototransistor, for example. The light sensor measures the brightness in the range from, by way of example, 10 lux to 1500 lux at a resolution of ±1%. By way of example, the light sensor is arranged as a sensor 5''' in the form of a light curtain for monitoring an area above the threshold of the elevator door 3. In this area, two strips containing photodiodes and phototransistors which are arranged on the side of the elevator door 3 send and receive infrared light. As soon as a passenger steps over the threshold of the elevator door 3 when entering or leaving the elevator cabin 1, the reception of transmitted infrared light is interrupted in regions and a sensor signal is produced.
- the camera has at least one optical lens and at least one digital image sensor. The digital image sensor is a Charged Coupled Device (CCD) sensor or a Complementary Metal Oxide Semiconductor (CMOS) sensor, for example. The camera captures images in the spectrum of visible light. The camera can capture still images or moving images at a rate of between 0 and 30 frames per second. From a computer readable data memory in the camera, at least one computer program means is loaded into a processor in the camera and is executed. The computer program means controls the operation of the camera, stores and loads still images, compares still images with one another and can produce at least one signal state change as a comparison result. The camera has an exemplary resolution of 2 MPixels and an exemplary sensitivity of 2 lux. The camera has a motor-operated zoom lens and is thus able to alter the focal length of the lens automatically or by remote control. It is therefore possible to capture objects at different distances in differently detailed image details. The camera has a motor operated stand so as to alter the orientation of the lens automatically or by remote control. By way of example, the camera pivots or rotates. The camera is provided with a lighting device and can thus light an object that is to be captured when the ambient light is low or it is dark. By way of example, the camera is arranged in the elevator cabin 1 as a sensor 5''' and captures a passenger entering or leaving the elevator cabin 1 as a sensor signal in the form of at least one image.

the ultrasonic sensor operates on the basis of echo time measurement and to this end uses an excited diaphragm, for example. When the ultrasound waves emitted by the diaphragm hit an object, they are reflected and the reflected ultrasound waves are captured. The transit time between the emitted ultrasound waves and the captured reflected ultrasound waves is used to ascertain a distance between the diaphragm and the object. The ultrasonic sensor captures movements at an exemplary resolution of 1 mm. By way of example, the ultrasonic sensor is arranged as a sensor 5'' in the vicinity of the elevator system A and captures a passenger in a region of a floor door 2 and/or elevator door 3 as a sensor signal.

the infrared sensor contactlessly captures radiated heat in an exemplary temperature measurement range between −30° C. and +500° C. at a resolution of ±1%. The infrared sensor provides thermal images of the radiated heat emitted by passengers. By way of example, the infrared sensor is arranged as a sensor 5'' in the vicinity of the elevator system A and captures a passenger in a region of a floor door 2 and/or elevator door 3 as a sensor signal.

The weighing apparatus is a load mat, for example, which captures the weight of a user standing on it in kilograms. Such load mats exist in different dimensions. For example, a load mat has a rectangular base area of 0.5 square meters and a thickness of 2 cm and captures a weight in the range between 1 kilogram and 200 kilograms. By way of example, the weighing apparatus is arranged as sensor 5''' in a floor of the elevator cabin 1 and captures a passenger entering or leaving the elevator cabin 1 as a sensor signal.

the noise level sensor captures intensities and noise levels. Intensities are captured at an exemplary resolution of between $10^{-3}$ $\mu Wm^2$ and $10^{+4}$ $\mu Wm^2$; the noise level is captured in an exemplary range between 30 dB and 110 dB at an exemplary resolution of 0.1 dB. By way of example, the noise level sensor is arranged as a sensor 5' in the elevator shaft S4. Alternatively, it is also possible for the noise level sensor to be designed as part of the call input apparatus 4, 4' and/or of the telephone 5, such that the noise level sensor captures a noise from a passenger in the vicinity of the call input apparatus 4, 4' as a sensor data signal 5.2.

the position sensor is a piezoelectric barometer or a laser triangulation sensor or a Global Positioning System (GPS), for example. The altimeter or the GPS is arranged as a sensor 5''' on the elevator cabin 1 and captures levels of the elevator cabin 1 in the elevator shaft S4 at an exemplary resolution of 30 cm and produces corresponding sensor signals. The laser triangulation sensor captures positions of the elevator cabin 1 in the elevator shaft S4 over an exemplary path range of between 0 and 200 m at an exemplary resolution of 5 mm.

the speed sensor is a radar sensor or an ultrasonic sensor, for example. The speed sensor measures speeds of the elevator cabin 1 in the range between 0 and +/−10 m/sec and at an exemplary resolution of 10 cm/sec and produces corresponding sensor signals. The speed sensor is arranged as a sensor 5''' on the elevator cabin 1 and/or on an elevator door 3.

the acceleration sensor measures accelerations and/or vibrations in the elevator cabin 1 in 1, 2 or 3 axes at an exemplary resolution of 10 mg, preferably 5 mg and produces corresponding sensor signals. Vibrations are measured Peak-to-Peak. The acceleration sensor is a Hall sensor or a piezoelectric sensor or a capacitive sensor, for example. The acceleration sensor is arranged as a sensor 5''' on the elevator cabin 1 and/or on an elevator door 3.

In knowledge of the present disclosure, the arrangements of the sensor 5' to 5''', which are shown by way of example, can naturally be combined and/or altered in any desired fashion. Thus, the camera and/or the weighing apparatus may also be arranged outside of the elevator cabin 1 on a floor S1 to S3 and/or in the elevator shaft S4. It is also possible for an ultrasonic sensor and/or an infrared sensor to be arranged in an elevator cabin 1. Finally, it is also possible for a light sensor to be arranged on a floor S1 to S3 in a region in front of a floor door 2. The sensor 5' to 5''' may be arranged at a relatively great distance of 50 or 100 m from the elevator system A, and it is thus able to capture a passenger when he approaches the elevator system A. The sensor 5' to 5''' may have further features. Thus, the noise level sensor may be a microphone which is coupled to a voice recognition system such that at least one spoken letter and/or number and/or word from the passenger is recognized as a sensor signal. It is also possible to use other sensors—not shown here—such as a biometric fingertip sensor, which captures a profile of a fingertip of a passenger as a sensor signal, or a biometric iris sensor, which captures an image of the iris of the passenger as a sensor signal.

The sensor signal indicates at least one status information item for the elevator system A. A typical status information item for the elevator system A is a statement relating to at least one operational readiness (yes/no), relating to at least one error log(list of error codes and/or messages), relating to at least one utilization level per unit time, etc. By way of example, a light sensor and/or a camera indicates as a status information item for the elevator cabin 1 whether a passenger is in the elevator cabin 1 and/or whether the elevator door 3 is closed or open. By way of example, an ultrasonic sensor and/or an infrared sensor and/or a noise level sensor indicates as a status information item for the elevator system A whether a passenger is in a region of a floor door 2 and/or an elevator door 3. By way of example, a weighing apparatus indicates as a status information item for the elevator cabin 1 whether a passenger is in the elevator cabin 1. By way of example, a position sensor indicates as a status information item for the elevator cabin 1 what level of the elevator shaft S4 the elevator cabin 1 is at. By way of example, an acceleration sensor indicates as a status information item for the elevator cabin 1 what accelerations and vibrations the elevator cabin 1 and/or parts of the elevator cabin 1 such as an elevator door 3, a door drive, etc. produces during operation.

At least one signal network 12 to 12"" allows signals to be transmitted from/to the elevator controller 10, the call controller 11, the elevator cabin telephone 5, the sensor 5' to 5''' and at least one communication apparatus 13 in the elevator system A. The signal network 12 to 12"" can be a landline network having at least one electrical or optical signal line. The signal network 12 to 12"" allows bidirectional communication on the basis of known and proven network protocols such as the Transmission Control Protocol/Internet-Protocol (TCP/IP), Internet Packet Exchange (IPX), Local Operating Network (LON), etc. The signal network 12 to 12"" may alternatively be a radio network, similar to the radio network 14 described below, so that this description also applies to the signal network 12 to 12"". Exemplary embodiments of the signal network 12 to 12"" are explained below:

- the signal network 12 may be an analogue telephone landline network 12 or Plain Old Telephone Service (POTS). In accordance with FIG. 1, ends of the telephone landline network 12 are connected to an FXO for the elevator cabin telephone 5 and to a Foreign Exchange Subscriber (FXS) for the communication apparatus 13. In accordance with FIG. 2, the communication apparatus 13 has at least one telephone port 13.6 for this telephone landline network 12 as an FXS. The telephone landline network 12 transmits not only a voice signal but also at least one Dual-Tone Multi Frequency (DTMF) data signal 5.2 from the elevator cabin telephone 5 to the communication apparatus 13. DTMF is a method for encoding, transmitting and recognizing control commands in the embodiment of DTMF signals in the telephone landline network. A DTMF signal comprises one of four tones, each of which is at a frequency in an audio frequency band, and one of four tones, each of which is at a frequency in a high frequency band. The following frequencies are assigned to the four tones in the audio frequency band: 697 Hz, 770 Hz, 852 Hz and 941 Hz; and the following frequencies are assigned to the four tones in the high frequency band: 1209 Hz, 1336 Hz, 1447 Hz and 1633 Hz. The frequencies used for DTMF encoding and recognition are defined by the Comité Consultatif International Téléphonique et Télégraphique (CCITT).
- the signal network 12', 12''' may be a databus 12', 12''' having a serial interface such as Universal Serial Bus (USB), Recommended Standard 232 (RS232), Recommended Standard 485 (RS485), etc. or a databus with a parallel interface such as Peripheral Component Interconnect (PCI), IEEE 1284, etc. In accordance with FIG. 1, sensors 5''' in the elevator cabin 1 and the communication apparatus 13 are connected to one another by means of a databus 12' in the exemplary embodiment of a USB, and the elevator controller 10 and the communication apparatus 13 are connected to one another by means of a databus 12''' in the exemplary embodiment of an RS485. In accordance with FIG. 2, the communication apparatus 13 has at least one bus port 13.7 for the databuses 12', 12'''.
- the signal network 12", 12"" may be a network 12", 12"" such as Ethernet, an Attached Resources Computer Network (ARCNET), a LON, etc. This network 12", 12"" is similar to the telephone landline network 14' described below, so that this description also applies to the network 12", 12"". In accordance with FIG. 1, the call controller 11 and the communication apparatus 13 are connected to one another by means of a network 12" in the exemplary embodiment of an Ethernet, and the sensors 5' on the floors S1 to S3 and also in the elevator shaft S4 and the communication apparatus 13 are connected to one another by means of a network 12"" in the exemplary embodiment of a LON. In accordance with FIG. 2, the communication apparatus 13 has at least two network ports 13.8 for these two networks 12", 12"". If the elevator cabin telephone 5 used is a digital telephone, it can use such a network to communicate with the communication apparatus 13.

At least one communication network 14 to 14" allows transmission of signals between the communication apparatus 13 in the elevator system A and at least one computer device 15 in at least one remote supervisory control center Z. Exemplary embodiments of the communication network 14 to 14" are explained below:

- the communication network 14 may be a telephone radio network 14 such as Global Systems for Mobile Communications (GSM), General Radio Packet Services (GPRS), Enhanced Data Rate for GSM Evolution (EDGE), Universal Mobile Telecommunications System (UMTS), High Speed Download Packet Access (HSDPA), etc. The frequencies used by the telephone radio network 14 are in bands between 800 and 900 MHz and between 1800 MHz and 1900 MHz for GSM and GPRS, and between 700 and 900 MHz and between 1700 MHz and 2700 MHz for UMTS and HSDPA. A communicative connection for the telephone radio network 14 is effected using at least one logical channel comprising at least one signaling channel and one user channel. The signaling channel is used for transmitting network-specific parameters, frequency corrections, time synchronization, etc. for the communicative connection. The signaling channel can also transmit voice and/or data. The user channel is used for exclusively transmitting voice and/or data. The logical channel is mapped onto at least one physical channel. A physical channel is formed by means of time and frequency division multiplexing or Time Division Multiplex Access (TDMA). Hence, communication in the telephone radio network 14 takes place in TDMA timeslots lasting 577 □sec. Eight successive TDMA timeslots form a TDMA frame. The same TDMA timeslots in successive TDMA frames form a physical channel. Setup 21 and maintenance of a communicative connection in the telephone radio network 14 is thus characterized by the use of at least one TDMA timeslot per TDMA frame. In this case, the signaling channel uses the allocated physical channel for continuous sending, while the user channel can interrupt the sending during speech pauses or data pauses in a discontinuous mode (Discontinuous Transmission or DTX). The transmission via the user channel may be either circuit-switched or packet-switched. The user channel may have different transfer rates of 13 kbit/sec, 6.5 kbit/sec. In the case of GSM, the maximum and also the effectively usable transfer rate is 9.6 kbit/sec. In the case of GPRS, the maximum transfer rate is 80 kbit/sec, but it is often possible to make effective use of only 50 kbit/sec, since the transfer capacity is split over all subscribers in a radio cell. In the case of EDGE, the maximum transfer rate is 256 kbit/sec, but effective use can be made of possibly only 150 kbit/sec on account of the transfer capacity being split over all the subscribers in a radio cell. For the same reasons, the maximum transfer rate for UMTS is 384 kbit/sec, of which possibly only 128 kbit/sec can effectively be used, however. Finally, in the case of HSDPA, the maximum transfer rate is 3.6 MBit/sec, of which possibly only 1 MBit/sec can effectively be used. To utilize the user channel efficiently, voice is compressed by a voice compressor in the transmitter prior to transmission and is expanded by a voice expander in the receiver following transmission.

the communication network 14' may be a telephone landline network 14' such as a Public Switched Telecommunication Network (PSTN). The telephone landline network 14' may be of analogue and/or digital design. In the case of an analogue telephone landline network 14', analogue audio signals are transmitted. The bandwidth is in this case limited to the frequency range from 300 Hz to 3400 Hz. Besides a voice signal, further signals such as a dialing signal, a call signal, etc. are transmitted. A digital telephone landline network 14' is known in the form of an Integrated Services Digital Network (ISDN), Asymmetric Digital Subscriber Line (ADSL), Very High Data Rate Digital Subscriber Line (VDSL), etc. In the case of ISDN, two user channels with a transfer rate of 64 kbit/sec each and a subscriber interface $S_0$ with a transfer rate of 16 kbit/sec are available. In the case of ADSL, a substantially larger frequency range between 200 Hz and 1.1 MHz is utilized, with the bandwidth up to 3400 Hz being used for the transmission of voice signals, while the bandwidth from 30 kHz to 1.1 MHz is used for the transmission of data signals. The transfer rate to the terminal is up to 8 MBit/sec for ADSL, while it can be above 200 MBit/sec for VDSL.

the communication network 14" may be a network 14" such as Ethernet, ARCNET, etc. for at least one electrical or optical signal line. In accordance with FIGS. 2 and 3, a network port 13.12 in the communication apparatus 13 and a network port 15.12 in the computer device 15 are connected to one another by means of a network 14". The network 14" allows bidirectional communication on the basis of known and proven network protocols such as the Transmission Control Protocol/Internet-Protocol (TCP/IP), Internet Packet Exchange (IPX), etc.

In accordance with FIG. 1, the communication apparatus 13 is a separate electronic unit in at least one dedicated housing which is arranged in the elevator shaft S4, for example. The communication apparatus 13 may also be an electronic slide-in unit, for example in the form of a printed circuit board, which printed circuit board is arranged in the housing of a call input apparatus 4, 4' and/or an elevator controller 10 and/or an escalator controller 10' and/or a call controller 11. In accordance with FIG. 2, the communication apparatus 13 has at least one processor 13.1; at least one computer-readable data memory 13.2; at least one telephone 13.3; at least one DTMF/CTM converter 13.4; at least one telephone port 13.6 and/or at least one bus port 13.7 and/or at least one network port 13.8 for at least one signal network 12 to 12""; and at least one radio antenna 13.10 and/or at least one landline network telephone port 13.11 and/or at least one network port 13.12 for at least one communication network 14 to 14"; and at least one electrical power supply 13.5. The communication apparatus 13 has eight landline network telephone ports 13.6, possibly four landline network telephone ports 13.6, possibly two landline network telephone ports 13.6. The communication apparatus 13 has 16 bus ports 13.7, possibly eight bus ports 13.7, possibly four bus ports 13.7. The communication apparatus 13 has four network ports 13.8, possibly two network ports 13.8, possibly one network port 13.8. The communication apparatus 13 has two radio antennas 13.10, possibly one radio antenna 13.10. The communication apparatus 13 has two landline network telephone ports 13.11, possibly one landline network telephone port 13.11. The communication apparatus 13 has two network ports 13.12, possibly one network port 13.12. From the computer readable data memory 13.2, at least one computer program means is loaded into the processor 13.1 via at least one signal line 13.16 and is executed. The computer program means controls the operation of the communication apparatus 13, which is described in detail below:

the telephone landline network 12 is used to transmit at least one voice signal and at least one DTMF signal from the elevator cabin telephone 5 to the telephone port 13.6 of the communication apparatus 13. The telephone port 13.6 of the communication apparatus 13 is connected by means of at least one signal line 13.13 to at least one DTMF/CTM converter 13.4 from DTMF to Cellular Text Modem (CTM). From the computer readable data memory 13.2, at least one computer program means is loaded into the DTMF/CTM converter 13.4 via at least one signal line 13.16 and is executed. The signal line 13.16 is used to transmit a voice signal received from the telephone port 13.6 and a DTMF signal as first signals to the DTMF/CTM converter 13.4. The DTMF/CTM converter 13.4 recognizes the voice signal and the DTMF signal. The DTMF/CTM converter 13.4 leaves the recognized voice signal unchanged and converts the recognized DTMF signal into a CTM signal. CTM is a method for encoding, recognizing and transmitting text and voice using a channel in a telephone radio network 14 and/or in a telephone landline network 14'. CTM is defined in Technical Specification (TS) 26.226 Version 0.0.5 from the 3rd Generation Partnership Projects (3GPP). At least one signal line 13.14 is either used to transmit the voice signal and the CTM signal as second signals from the DTMF/CTM converter 13.4 to the processor 13.1 and/or the voice signal and the CTM signal are transmitted as second signals via at least one signal line 13.15 from the DTMF/CTM converter 13.4 to the telephone 13.3. The processor 13.1 either transmits the second signals via at least one signal line 13.18 to the network port 13.12 and/or the second signals are transmitted from the processor 13.1 via at least one signal line 13.17 to the telephone 13.3. The telephone either transmits the second signals via at least one signal line 13.20 to the radio antenna 13.10 and/or the second signals are transmitted from the telephone 13.3 via at least one signal line 13.21 to the landline network telephone port 13.11.

A data signal applied to the bus port 13.7 and/or to the network port 13.8 by the elevator controller 10 and/or by the escalator controller 10' and/or by the call controller 11 and/or a sensor signal from a sensor 5' to 5'" are transmitted as first signals via the signal line 13.14 to the processor 13.1. The processor 13.1 monitors and supervises the maintenance of the communicative connections in the signal network 12' to 12"" and/or in the communication network 14 to 14". The processor 13.1 also outputs at least one data signal as a first signal, which first signal indicates at least one status information item for the communication apparatus 13. A typical status information item for the communication apparatus 13 is a statement relating to at least one operational readiness (yes/no), relating to at least one error log (list of error codes and/or messages), relating to at least one utilization level per unit time, etc. The processor 13.1 converts the protocol of the signal network 12' to 12"" into the protocol of the communication network 14 to 14". First signals in the form of a data signal and/or sensor signal from the signal network 12' to 12"" are in this case converted into second signals in the form of a data signal and/or sensor signal from the communication network 14 to 14". The processor 13.1 either transmits the second signals via the signal line 13.18 to the network port 13.12 and/or the second signals are transmitted from the processor 13.1 via the signal line 13.17 to the telephone 13.3. The telephone 13.3 either transmits the second signals via the signal line 13.20 to the radio antenna 13.10 and/or the second signals are transmitted from the telephone 13.3 via the signal line 13.21 to the landline network telephone port 13.11.

The electrical power supply 13.5 of the communication apparatus 13 can be connected to a building power supply system and/or to the elevator controller 10 by means of a supply line 13.19 using a port 13.9. The building power supply system is standardized and has an electrical voltage of approximately 380 VAC or 220 VAC at a frequency of 50 Hz for three phase current, for example, and has an electrical voltage between 90 VAC and 270 VAC at frequencies between 40 Hz and 60 Hz for alternating current. By way of example, the elevator controller 10 has an output for DC voltage and delivers an electrical voltage of 24 VDC or 42 VDC. The electrical power supply 13.5 supplies the communication apparatus 13 and also a signal network 12, 12", 12"" connected thereto, such as a telephone landline network 12, with approximately 60 VDC and/or supplies a signal network 12", 12"" such as a databus 12", 12"" with approximately 5 VDC and/or supplies an Ethernet with approximately 48 VDC. In knowledge of the present disclosure, a person skilled in the art can also use an autarchic electrical power supply 13.5 such as a battery, a storage battery, a fuel cell, etc. The autarchy of the electrical power supply 13.5 is one year, for example, preferably two years. An autarchic electrical power supply 13.5 of this kind can be replaced by a service engineer.

In accordance with FIG. 1, the remote supervisory control center Z is arranged remotely from the building of the elevator system A. The remote supervisory control center Z may be mobile and/or fixed. By way of example, a mobile remote supervisory control center Z is a service engineer in an automobile. By way of example, a fixed remote supervisory control center Z is a remote servicing center for the remote servicing of a plurality of elevator systems. In relatively large buildings with one or more elevator systems A, the remote supervisory control center Z may also be arranged in the building. A person skilled in the art can therefore arrange a remote supervisory control center Z in a reception area for the building of the elevator system A. The remote supervisory control center Z has at least one computer unit 15. In accordance with FIG. 3, the computer unit 15 has at least one processor 15.1; at least one computer-readable data memory 15.2; at least one telephone 15.3; at least one DTMF/CTM converter 15.4; at least one network port 15.8 for a network 16; at least one radio antenna 15.10 and/or at least one landline network telephone port 15.11 and/or at least one network port 15.12 for at least one communication network 14 to 14"; and at least one electrical power supply 15.5. From the computer readable data memory 15.2, at least one computer program means is loaded into the processor 15.1 via at least one signal line 15.16 and is executed. The computer program means controls the operation of the computer unit 15, which is described in detail below:

a telephone radio network 14 and/or radio network 14 are used to transmit second signals to the radio antenna 15.10; and/or second signals are transmitted via the telephone landline network 14' to the landline network telephone port 15.11. The second signals are transmitted from the radio antenna 15.10 via at least one signal line 15.20 to the telephone 15.3; and/or the second signals are transmitted from the landline network telephone port 15.11 via at least one signal line 15.21 to the telephone 15.3. At least one signal line 15.17 is either used to transmit the second signals from the telephone 15.3 to the processor 13.1 and/or the second signals are transmitted via at least one signal line 15.15 from the telephone 15.3 to the DTMF/CTM converter 15.4.

From the computer readable data memory 15.2, at least one computer program means is loaded into the DTMF/CTM converter 15.4 via at least one signal line 15.16 and is executed. The DTMF/CTM converter 15.4 recognizes the second signals as at least one voice signal and as at least one CTM signal. The DTMF/CTM converter 15.4 leaves the recognized voice signal unchanged and converts the recognized CTM signal into a DTMF signal. At least one signal line 15.14 is used to transmit the recognized voice signal and the converted DTMF signal from the DTMF/CTM converter 15.4 as first signals to the processor 15.1 and/or to the network port 15.8 of the network 16.

The network 14" is used to transmit second signals to the network port 15.12; and the network port 15.12 transmits the second signals via at least one signal line 15.18 to the processor 15.1. The processor 15.1 converts the protocol of the communication network 14 to 14". Second signals in the form of a data signal and/or sensor signal from the communication network 14 to 14" are in this case converted into first signals in the form of a data signal and/or sensor signal from at least the network 16. At least one signal line 15.14 is used by the processor 5.1 to transmit the first signals to the network port 15.8 of the network 16.

The computer program means in the computer device 15 evaluates the first signals from the elevator system A. Possibly, the computer program means evaluates a first signal in the form of a data signal from the elevator cabin telephone 5 and/or the computer program means evaluates a first signal in the form of a data signal from the elevator controller 10 and/or from the escalator controller 10' and/or from the call controller 11 and/or from the communication apparatus 13; and/or the computer program means evaluates a first signal in the form of a sensor signal from the sensor 5' to 5'. The first signals indicate at least one status information item for the elevator system A and/or for the elevator controller 10 and/or for the escalator controller 10' and/or for the call controller 11 and/or for the communication apparatus 13. A typical status information item is a statement relating to at least one operational readiness (yes/no), relating to at least one error log (list of error codes and/or messages), relating to at least one utilization level per unit time, etc. With knowledge of the present disclosure, a person skilled in the art can naturally also implement evaluation of the transmitted second signals by the computer device 15 without these being converted (back) into first signals. As the result of the evaluation, the computer program means produces at least one positive result signal and/or a negative result signal. A positive result signal indicates that the elevator system A is available; and/or that the elevator controller 10 is available; and/or that the escalator controller 10' is available; and/or that the call controller 11 is available; and/or that the communication apparatus 13 is available; and/or that the elevator cabin telephone 5 is available; and/or that the sensor 5' to 5''' is available; and/or that a passenger is not trapped in the elevator cabin 1; and/or that the floor door 2 and/or the elevator door 3 is closed. A negative result signal indicates that the elevator system A is not available; and/or that the elevator controller 10 is not available; and/or that the escalator controller 10' is not available and/or that the call controller 11 is not available; and/or that the communication apparatus 13 is not available; and/or that the elevator cabin telephone 5 is not available; and/or that the sensor 5' to 5''' is not available; and/or that a passenger is trapped in the elevator cabin 1; and/or that a floor door 2 and/or an elevator door 3 is open. If the elevator controller 10 and/or the escalator controller 10' and/or the call controller 11 and/or the communication apparatus 13 and/or the elevator cabin telephone 5 and/or the sensor 5' to 5''' is/are unavailable, the computer device 15 transmits at least one Short Message Service (SMS) signal via the communicative connection to the communication apparatus 13 of the elevator system A. The SMS signal is a short message with a user data length of 1120 bits, for example. The SMS signal is either sent using a signaling channel in the telephone radio network 14, such as GSM. Alternatively, it is also possible for the GSM to be transmitted using the telephone landline network 14' and/or using the network 14" such as the Internet. The radio network 14 such as GSM is used to transmit the SMS signal in parallel with the communicative connection. An SMS signal is used to reconfigure and/or boot the elevator controller 10 and/or the escalator controller 10' and/or the call controller 11 and/or the communication apparatus 13 and/or the elevator cabin telephone 5 and/or the sensor 5' to 5'''. It is self-explanatory that the SMS signals are apparatus specific and function specific, i.e. that instructions and commands in an SMS signal for reconfiguring and/or rebooting 20 the communication apparatus 13 are different from an SMS signal for reconfiguring and/or rebooting the elevator cabin telephone 5. The SMS signals are also transmitted from the computer device 15 to the terminal. In accordance with FIG. 1, an SMS signal for reconfiguring and/or rebooting the elevator controller 10 is transmitted via the communication network 14 to 14" at the communication apparatus 13 and from there via the databus 12''' to the elevator controller 10; an SMS signal for reconfiguring and/or rebooting the escalator controller 10' is transmitted via the communication network 14 to 14" to the communication apparatus 13 and from there via the databus 12'''' to the escalator controller 10'; an SMS signal for reconfiguring and/or rebooting the call controller 11 is transmitted via the communication network 14 to 14" to the communication apparatus 13 and from there via a network 12" to the call controller 11; an SMS signal for reconfiguring and/or rebooting the communication apparatus 13 is transmitted via the communication network 14 to 14" to the communication apparatus 13; an SMS signal for reconfiguring and/or rebooting the elevator cabin telephone 5 is transmitted via the communication network 14 to 14" to the communication apparatus 13 and from there via the telephone landline network 12 to the elevator cabin telephone 5; an SMS signal for reconfiguring and/or rebooting a sensor 5' to 5''' is transmitted via the communication network 14 to 14" to the communication apparatus 13 and from there via the databus 12' or the network 12'''' to the sensor 5' to 5'''. With knowledge of the present disclosure, a person skilled in the art can naturally use another proven signal format, such as Hypertext Markup Language (HTML), TeX, etc., instead of an SMS signal.

The network 16 largely corresponds to the network 12", 12'''' described previously and/or to the telephone radio network 14 and/or to the radio network 14 and/or to the telephone landline network 14' and/or to the network 14" of the communication apparatus 13, so that reference is made to this description. With knowledge of the present disclosure, evaluation of first signals from the elevator system A and hence monitoring of the elevator system A can also be effected by apparatuses of the remote supervisory control center Z which are connected to the network 16.

The electrical power supply 15.5 of the remote supervisory control center 15 can be connected to a building power supply system by means of a supply line 15.19 using a port 15.9. The building power supply system largely corresponds to the building power supply system described previously for the communication apparatus 13, so that reference is made to this description.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. We therefore claim as our invention all that comes within the scope and spirit of these claims.

The invention claimed is:

1. An elevator system communication method, comprising:

setting up at least one communicative connection by at least one communication apparatus in at least one communication network, said setting up comprising the at least one communication apparatus transmitting a signal;

receiving, using the at least one communication apparatus and at least one signal network, at least one first signal from an elevator system, the at least one first signal comprising a data signal and a voice signal, the at least one first signal being from an elevator cabin telephone; and transmitting, using the at least one communication apparatus and the at least one communication network, at least one second signal to at least one computer device in a remote supervisory control center, the at least one communicative connection being maintained permanently;

wherein at least one firewall in the communication apparatus prevents any signal reception via the communicative connection.

2. The elevator system communication method of claim 1, the at least one first signal comprising a sensor signal.

3. The elevator system communication method of claim 2, the sensor signal indicating an operational readiness of the elevator system, at least one error of the elevator system, or at least one utilization level of the elevator system.

4. The elevator system communication method of claim 1, further comprising rebooting the at least one communication apparatus as a result of receiving a short message service (SMS) message from the remote supervisory control center.

5. An elevator installation, comprising:

an elevator car disposed in an elevator shaft;

an elevator cabin sensor coupled to the elevator car; and a computer-based communication device, the communication device being coupled to the elevator cabin sensor and configured to, set up at least one communicative connection in at least one communication network by transmitting a signal, receive at least one first signal from the elevator cabin sensor, wherein the at least one first signal is captured by an elevator cabin telephone and comprises a data signal and a voice signal, transmit at least one second signal to at least one computer device in a remote supervisory control center using the at least one communicative connection, the at least one communicative connection being maintained permanently, and use a firewall to prevent any signal reception via the communicative connection.

6. One or more computer-readable memories having encoded thereon instructions that, when executed by a processor, cause the processor to perform a method, the method comprising:

setting up at least one communicative connection in at least one communication network, said setting up comprising at least one communication apparatus transmitting a signal;

receiving, using the at least one communication apparatus and at least one network, at least one first signal from an elevator system; and transmitting, using the at least one communication apparatus and at least one communication network, at least one second signal to at least one computer device in a remote control center, the at least one communicative connection being maintained permanently; and causing at least one firewall in the communication apparatus to prevent any signal reception via the communicative connection.

7. A method for communication between at least one elevator system and at least one remote supervisory control center, the method comprising:

setting up at least one communicative connection in at least one communication network, said setting up comprising at least one communication apparatus transmitting a signal;

receiving at least one first signal from the elevator system by the at least one communication apparatus in the at least one elevator system via at least one signal network;

transmitting at least one second signal from the communication apparatus in the communication network to at least one computer device in the remote supervisory control center, the communicative connection being maintained permanently; and causing at least one firewall in the communication apparatus to prevent any signal reception via the communicative connection.

* * * * *